US006568198B1

(12) United States Patent
Tadano et al.

(10) Patent No.: US 6,568,198 B1
(45) Date of Patent: May 27, 2003

(54) MULTI-STAGE COMPRESSION REFRIGERATING DEVICE

(75) Inventors: Masaya Tadano, Moriguchi (JP); Atsushi Oda, Moriguchi (JP); Toshiyuki Ebara, Moriguchi (JP); Takashi Yamakawa, Moriguchi (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 10/030,073

(22) PCT Filed: Sep. 25, 2000

(86) PCT No.: PCT/JP00/06585

§ 371 (c)(1),
(2), (4) Date: Jan. 10, 2002

(87) PCT Pub. No.: WO01/22008

PCT Pub. Date: Mar. 29, 2001

(30) Foreign Application Priority Data

Sep. 24, 1999 (JP) ..... 11-270906
Mar. 24, 2000 (JP) ..... 2000-083560

(51) Int. Cl.[7] ..... F25B 41/04; F25B 1/10
(52) U.S. Cl. ..... 62/217; 62/510
(58) Field of Search ..... 62/217, 510, 513, 62/113

(56) References Cited

U.S. PATENT DOCUMENTS 4,918,942 A * 4/1990 Jaster ..... 62/335
5,094,085 A * 3/1992 Irino ..... 62/175

(List continued on next page.)

FOREIGN PATENT DOCUMENTS

JP 51-21338 2/1976
JP 52-58148 5/1977
JP 55-26764 6/1980
JP 60-128990 7/1985

OTHER PUBLICATIONS

International Search Report dated Dec. 26, 2000.

Microfilm of the specification and drawings annexed to the request of Japanese Utility Model Application No. 13303/1983 (Laid–open No. 118975/1984) (Mitsubishi Heavy Industries, Ltd.), Aug. 10, 1984.

(List continued on next page.)

*Primary Examiner*—Denise L. Esquivel
*Assistant Examiner*—Marc Norman
(74) *Attorney, Agent, or Firm*—Armstrong, Westerman & Hattori, LLP

(57) ABSTRACT

A multi-stage compression refrigeration apparatus (10) includes a compressor having a first stage low-pressure compression means (32) and a second stage high-pressure compression means (34), a condenser (1), a first decompression means (3), an intercooler (6), a second decompression means (7), and an evaporator (8). The refrigerant discharged from the condenser (1) is diverted into first and second parts, with the first part passed to the intercooler (6) via the first decompression means (3) while the second part is passed to the evaporator (8) via the second decompressor (7). The refrigerant passed to the second decompressor (7) undergoes heat exchange with the intercooler (6). The refrigerant discharged from the evaporator (8) is fed to the low-pressure compression means (32). The refrigerant discharged from the intercooler (6) is fed to the high-pressure compression means (34) together with the refrigerant discharged from the low-pressure compression means. The apparatus further comprises a second intercooler (5) downstream of the evaporator (8) so that the second diverted part of the refrigerant may undergo heat exchange in the intercooler (5) prior to entering the evaporator. The inventive apparatus thus may perform refrigeration with an improved efficiency during an early stage of its startup.

10 Claims, 6 Drawing Sheets

U.S. PATENT DOCUMENTS

| | | | | | |
|---|---|---|---|---|---|
| 5,095,712 | A | * | 3/1992 | Narreau | 62/113 |
| 5,235,820 | A | * | 8/1993 | Radermacher et al. | 62/114 |
| 6,189,335 | B1 | * | 2/2001 | Ebara et al. | 62/510 |

OTHER PUBLICATIONS

Microfilm of the specification and drawings annexed to the request of Japanese Utility Model Application No. 190972/1987 (Laid–open No. 94116/1989) (Mitsubishi Motors Corporation), Jun. 21, 1989.

Microfilm of the specification and drawings annexed to the request of Japanese Utility Model Application No. 4105/1987 (Laid–open No. 112296/1988) (Sanyo Electric Co., Ltd.) Jul. 19, 1988.

* cited by examiner

MULTI-STAGE COMPRESSION REFRIGERATING DEVICE

FIELD OF THE INVENTION

The invention relates to a multi-stage compression refrigeration apparatus having a multiplicity of compression means for compressing a refrigerant in multi-stages.

BACKGROUND OF THE INVENTION

A typical multi-stage compression refrigeration apparatus for use in a refrigerator and an air conditioner includes a rotary compressor consisting of a first and a second stage compression means which are housed in an enclosed container and each have a roller for compressing a refrigerant in the respective cylinder. The compressor performs compression of the refrigerant in two stages, first by the first stage compression means serving as a low-pressure compressor and then by the second stage compression means serving as a high-pressure compressor adapted to further compress the refrigerant gas compressed by the first stage low-pressure compressor.

Such a multi-stage compression refrigeration apparatus can attain a high compression ratio while suppressing variations of torque per one compression.

However, such multi-stage compressor has a drawback in that when a refrigerant has a high specific heat ratio, the second stage compression means has a low suction efficiency because it receives hot refrigerant heated by the first stage compression means. The multi-stage compressor also suffers from a further disadvantage that the temperature of the refrigerant is heated in the second stage high-pressure compression means to a great extent that the lubricant used therein will be thermally hydrolyzed into acids and alcohol, particularly when ester oil (for example, polyol ester, POE) is used. These acids disadvantageously develop sludges which tend to clog capillary tubes of the compressor, degrade the lubricant, and hence lower the performance of the apparatus.

In order to circumvent these problems, some compressors are provided with a cooling unit for cooling the refrigerant gas discharged from the first stage compression means before it is supplied to the second stage high-pressure compression means, thereby sufficiently lowering the temperature of the refrigerant gas discharged from the second stage compressor. For example, one type of such multi-stage compression refrigeration apparatus as shown in FIG. 5 has: a multi-stage compressor 511 which consists of a first stage low-pressure compression means and a second stage high-pressure compression means; a condenser 512; a first decompression means 513, an intercooler 514, a second decompression means 515, and an evaporator 516. The refrigerant exiting the condenser 512 is diverted into two parts, with one part passed to the intercooler 514 via the first decompression means 513, but the other part passed directly to the intercooler 514, and then passed to the second decompression means 515 and the evaporator 516. The two parts undergo heat exchange in the intercooler 514. The refrigerant exiting the evaporator 516 is fed to the first stage compression means of the multi-stage compressor 511. On the other hand, the part of the refrigerant that has passed through the intercooler 514 is mixed with the refrigerant discharged from the first stage low-pressure compression means before entering the second stage compression means.

Thus, this multi-stage compression refrigeration apparatus has a refrigeration cycle as depicted in the P-h diagram (solid line) shown in FIG. 6. In this conventional apparatus, the enthalpy of the refrigerant is reduced by δHo, as shown in FIG. 6, by the heat exchange between the two parts of the refrigerant in the intercooler 514, i.e. heat exchange between the refrigerant passed through the first decompression means 513 and the refrigerant passed directly to the intercooler 514. This arrangement may increase an enthalpy difference across the evaporator 516.

However, such conventional apparatus fails to cool the refrigerant in the intercooler 514 sufficiently prior to decompression by the second decompression means 515 due to the sensible heat in the tubes of the intercooler 514 for example, so that, at an early stage of a start-up operation, the evaporator 516 cannot create intended enthalpy difference δHo required for a normal operation (as indicated in FIG. 6).

Another drawback pertinent to the prior art apparatus is that, following stopping of the refrigeration operation, hot refrigerant in the condenser 512 flows into the evaporator 516 via the second decompression means 515, resulting in a large amount of liquefied refrigerant staying in the evaporator 516. Hence, it takes a fairly long time to have the entire liquefied refrigerant in the evaporator 516 to be evaporated during a restart of the compressor 511, thereby requiring a time for the apparatus to recover its normal operating condition. This lowers the efficiency of the apparatus.

As a measure to circumvent this problem, an integral valve system might be provided which has cooperative first and second valves mounted upstream and downstream ends, respectively, of the evaporator 516, such that the first valve is closed in response to a backflow from the compressor 511 following the stopping of the compressor and the second valve is then closed in response to the first valve, thereby stopping the backflow from the second decompression means 515 to the evaporator 516.

In this arrangement, the backflow of the liquid refrigerant into the evaporator 516 can be prevented. However, in an apparatus as mentioned above where the refrigerant discharged from the first stage compression means is mixed with the refrigerant from the condenser 512 before it is fed to the second refrigeration means, hot liquid refrigerant remaining in the condenser 512 will flow into the intercooler 514 after the compressor 511 is stopped. As a result, when the apparatus is restarted, sensible heat that remains in the intercooler 514 will prevent sufficient cooling of the refrigerant in the intercooler 514 before passing it to the second decompression means 515. Consequently, super-cooling of the refrigerant for the intended enthalpy difference δHo is not obtained by the evaporator 516.

It is therefore an object of the invention to overcome the problems as mentioned above by providing an improved multi-stage compression refrigeration apparatus having a first and a second stage compression means and equipped with an intercooler which is adapted to cool the compressed refrigerant gas discharged from the first (low-pressure) compression means. Thus, the apparatus is capable of lowering the temperature of the gas discharged from the second (high-pressure) compression means to create a large enthalpy difference in an evaporator during an early stage of startup.

It is another object of the invention to provide an improved multi-stage compression refrigeration apparatus adapted to stop the backflow of refrigerant into the evaporator and the intercooler when the apparatus is stopped, thereby allowing the apparatus to resume creation of a large enthalpy and attain an improved refrigeration efficiency during an early stage of startup.

DISCLOSURE OF THE INVENTION

In accordance with one embodiment of the invention, there is provided a multi-stage compression refrigeration apparatus including a compressor having a first stage low-pressure compression means and a second stage high-pressure compression means, a condenser, a first decompression means, a first intercooler, a second decompression means, and an evaporator, wherein the refrigerant discharged from the second stage compression means is passed through the condenser, and is diverted into first and second parts, with the first part passed to the first intercooler via the first decompression means, while the second part is passed to the first intercooler to undergo heat exchange therein with the first part, and then passed to the second decompression means, the evaporator, and-further to the first stage low-pressure compression means; and wherein the first part of the refrigerant exiting the first intercooler is mixed with the second part of the refrigerant discharged from the first stage low-pressure compression means before they are fed to the second stage high-pressure compression means of the multi-stage compression refrigeration apparatus, the apparatus further comprising a second intercooler mounted downstream of the evaporator, adapted to perform heat exchange between the refrigerant that has passed the evaporator and the second part of the refrigerant before entering the evaporator.

This arrangement may sufficiently lower the temperature of the refrigerant gas discharged from the second stage compression means, and create a larger enthalpy difference in the evaporator than conventional apparatuses during an early stage of startup.

The refrigeration apparatus may be further provided with a third intercooler mounted downstream of the condenser for performing heat exchange between the refrigerant discharged from the condenser and the refrigerant discharged from the first intercooler before the latter refrigerant is mixed with the refrigerant exiting the first stage compression means, thereby feeding the mixed refrigerant to the second stage compression means. This arrangement ensures further improvement of efficiency of the apparatus.

The refrigeration apparatus may be provided with a third decompression means for decompressing the second part of the diverted refrigerant after the refrigerant has undergone the heat exchange in the second intercooler. The temperature of the refrigerant entering the evaporator is further lowered in this arrangement.

In accordance with another embodiment of the invention, there is provided a multi-stage compression refrigeration apparatus including a compressor having a first stage low-pressure compression means and a second stage high-pressure compression means, a condenser, a first decompression means, a first intercooler, a second decompression means, and an evaporator, wherein the refrigerant discharged from the second stage compression means is passed through the condenser, and is diverted into a first and a second parts, with the first part passed to the first intercooler via the first decompression means while the second part is passed to the first intercooler to undergo heat exchange therein with the first part, and then passed to the second decompression means, the evaporator, and then to the first stage low-pressure compression means; and wherein the first part of the refrigerant exiting the first intercooler is mixed with the second part of the refrigerant discharged from the first stage low-pressure compression means before they are fed to the second stage high-pressure compression means of the multi-stage compression refrigeration apparatus, the apparatus further comprising:

a first valve mechanism which is mounted upstream of the first stage compression means and adapted to be fully closed in response to a predetermined amount of backflow of refrigerant from the first stage compression means towards the evaporator;

a second valve mechanism which is mounted upstream of the evaporator and adapted to be opened/closed in cooperation with the first valve mechanism; and a third valve mechanism mounted downstream of the condenser, adapted to be opened/closed in cooperation with the first valve mechanism.

In this arrangement, should a backflow of the refrigerant gas in the first valve mechanism take place following stopping the compressor, the backflow into the evaporator and the first intercooler will be prevented by the respective second and third valve mechanisms, since they are fully closed upon occurrence of the backflow in the first valve mechanism.

The refrigeration apparatus may be further provided with a fourth valve mechanism which is mounted upstream of the first decompression means and adapted to be opened/closed in cooperation with the first valve mechanism, thereby preventing a backflow of the liquid refrigerant remaining in the refrigerant lines into the first intercooler following stopping the compressor.

The compressor may be of a multi-stage compression rotary compressor having a multi-stage compression mechanism which includes:

an electric motor contained in an enclosed container;

a rotary compression unit having a first stage low-pressure compression element and a second stage high-pressure compression element, both elements operatively coupled to the drive shaft of the electric motor element; and a communicating tube for connecting the discharge port of the first stage low-pressure compression element and the inlet port of the second stage high-pressure compression element.

The compressor may be adapted to run in a reverse direction for a predetermined period of time before the compressor is stopped. In this arrangement, the refrigerant gas can be immediately flown from the outlet port of the compressor back to the first valve mechanism following the stopping operation.

The second, third, and fourth valve mechanisms may be constructed integral with the first valve mechanism.

The second decompression means may be a capillary tube, and the second valve mechanism may be connected to the inlet of the capillary tube. This arrangement enables down-sizing of the refrigeration apparatus in cases where the evaporator is installed inside a housing but other components are installed outside the housing of the apparatus by connecting them with the evaporator with a long capillary tube, because then the integral valve mechanisms can be installed together with the components outside the housing.

The refrigeration apparatus may be provided with a third decompression means adapted to decompress the second part of the refrigerant prior to flowing into the first intercooler; and a second intercooler adapted to perform heat exchange between the second part of the refrigerant prior to flowing into the third decompression means and the refrigerant discharged from the evaporator. This arrangement may increase more than conventional apparatuses enthalpy changes by the evaporator during an early stage of startup.

The refrigeration apparatus may be provided with a third intercooler adapted to perform heat exchange between the first part of the refrigerator which has undergone heat exchange in the first intercooler, and the second part of the refrigerant discharged from the condenser.

BEST MODE FOR CARRYING OUT THE INVENTION

The invention will now be described by way of example with reference to FIGS. 1–4 illustrating an embodiment of a multi-stage compression refrigeration apparatus according to the invention.

Figure 2:
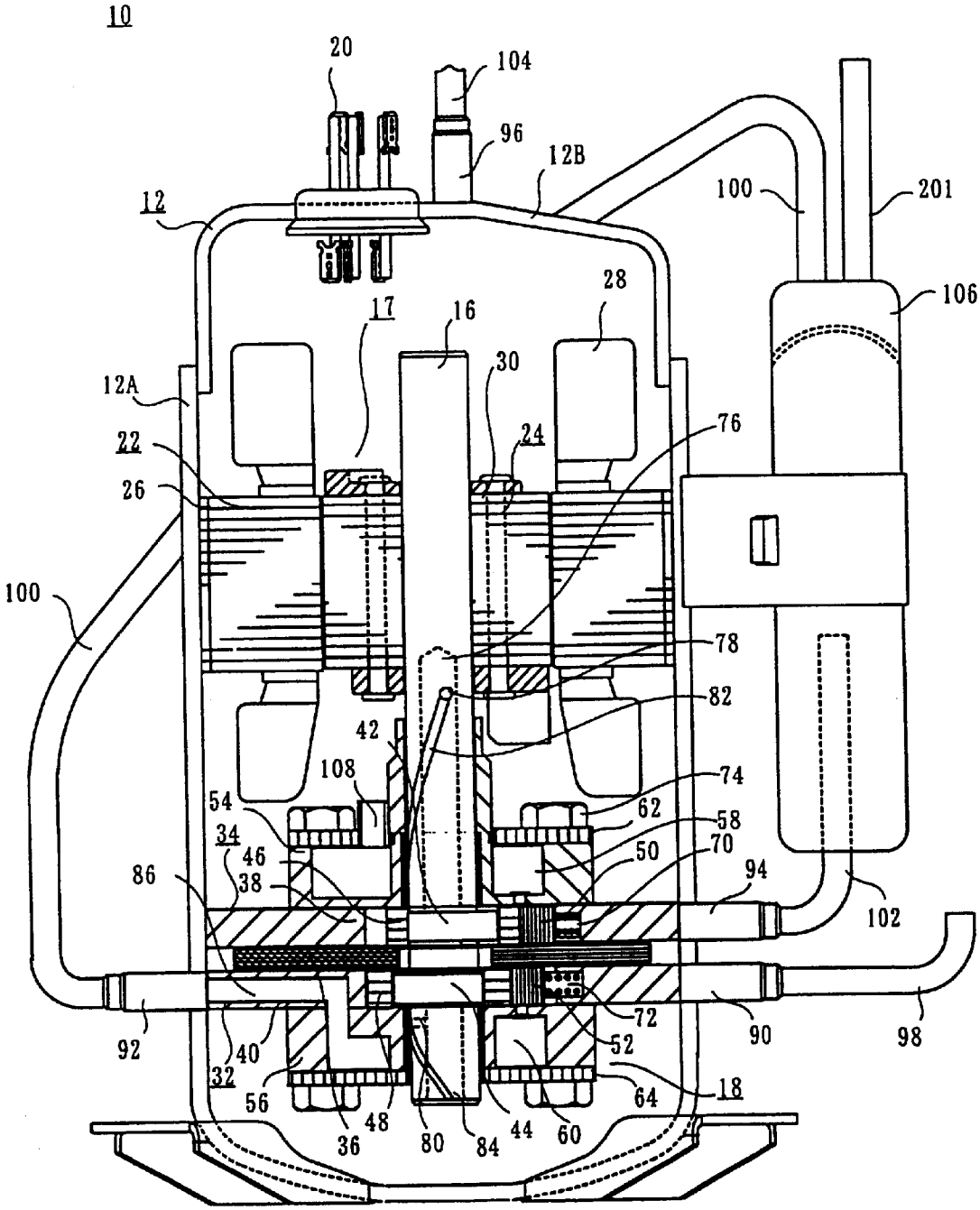
FIG. 2 shows a longitudinal cross section of the major part of a two-stage compression rotary compressor according to the invention.

Referring to FIG. 2, there is shown a multi-stage compression means in the form of two-stage compression rotary compressor 10, which has a generally cylindrical enclosed steel container 12, an electric motor 17 installed in an upper space of the container 12, and a compression element in the form of rotary compression mechanism 18 which is installed in a space below the electric motor 17 and operatively connected with the electric motor 17 by a crank shaft 16.

The container 12 has an oil sump at the bottom thereof, and consists of a container body 12A for accommodating the electric motor 17 and the rotary compression mechanism 18, and a cover member 12B for closing an upper opening formed in the container body 12A. The cover member 12B has a set of terminals (lead wires not shown) 20 for supplying the electric motor 17 with electric power from an external power source.

The electric motor 17 has a stator 22 toroidally mounted on the inner surface of the enclosed container 12, and a rotor 24 mounted inside the stator 22 with a little gap between them. The rotor 24 may be integral with the crank shaft 16 vertically extending through the center of the rotor.

The stator 22 includes a stack 26 of electromagnetically susceptible annular steel plates, and a multiplicity of coils 28 wound on the stack 26. Like the stator 22, the rotor 24 is also composed of a stack 30 of a multiplicity of electromagnetically susceptible steel plates. In the example shown herein, the electric motor 17 is an AC motor, which can be replaced by a DC motor having permanent magnets.

The rotary compression mechanism 18 includes a first stage low-pressure compression element 32 serving as a low-pressure compression means, and a second stage high-pressure compression element 34 serving as a high-pressure compression means. Specifically, the rotary compression mechanism 18 consists of an intermediate partition panel 36; upper and lower cylinders 38 and 40, respectively, provided above and below the intermediate partition panel 36; upper and lower rollers 46 and 48, respectively, connected with respective upper and lower eccentric members 42 and 44 which are mounted on the crank shaft 16 for rotation inside the upper and lower cylinders 38 and 40; upper and lower vanes 50 and 52, respectively, in contact with the respective upper and lower rollers 46 and 48, for partitioning the respective spaces of the upper and lower cylinders 38 and 40 into respective suction chambers (inlet sides of the spaces) and compression chambers (outlet sides of the spaces); and upper and lower support members 54 and 56, respectively, for bearing the crank shaft 16 and for closing the openings of the respective upper and lower cylinders 38 and 40.

Provided above and below the respective upper and lower support members 54 and 56 are discharge sound silencer chambers 58 and 60 formed to appropriately communicate with the upper and the lower cylinders 38 and 40, respectively, via valve means (not shown). The openings of these discharge sound silencers are closed by upper and lower plates 62 and 64, respectively.

The upper and lower vanes 50 and 52, respectively, are sidably mounded in the respective radial guide grooves (not shown) formed in the cylinder walls of the upper and lower cylinders 38 and 40, and biased by respective springs 70 and 72 to always abut on the respective upper and lower rollers 46 and 48.

In the lower cylinder 40, first stage (low-pressure) compression is performed, while in the upper cylinder 38 second stage (higher pressure) compression of the refrigerant gas is performed.

In the example shown herein, the upper support member 54, the upper cylinder 38, the intermediate partition panel 36, the lower cylinder 40, and the lower support member 56 are placed in the order mentioned and sandwiched by the upper and the lower plates 62 and 64, respectively, and securely fixed by a multiplicity of mounting.bolts 74 to all together constitute the rotary compression mechanism 18.

Formed through the shaft 16 is a straight oiling bore 76, which communicates with spiral oiling grooves 82 and 84 via transverse oiling bores 78 and 80, to supply oil to the respective bearings and to those members in sliding contact.

In the embodiment shown herein, refrigerant R404A is used. The lubricant can be any of conventional lubricants such as mineral oils, alkylbenzen oils, poly-alkylene glycol (PAG) oils, ether oils, and ester oils.

The first stage low-pressure compression element 32 of the above described rotary compression mechanism 18 is designed to operate at inlet refrigerant pressure of 0.05 MPa and discharge refrigerant pressure of 0.18 MPa. The second stage high-pressure compression element 34 operates at inlet refrigerant pressure of 0.18 MPa, and discharge refrigerant pressure of 1.90 MPa.

The upper and lower cylinders 38 and 40 are provided with upper and lower refrigerant suction passages (not shown) for introducing the refrigerant, and with a discharge passage 86 for discharging the compressed refrigerant via the discharge sound silencer chambers 58 and 60. Each of the refrigerant suction passages and refrigerant discharge passage 86 are connected with respective refrigerant lines 98, 100, and 102 via connection tubes 90, 92, and 94 which are secured to the enclosed container 12. Connected between the refrigerant lines 100 and 102 is a suction muffler 106 working as a liquid-gas separator.

In the suction muffler 106, the refrigerant from the line 100 merges with the refrigerant from a refrigerant line 201 connected with a third intercooler (not shown) mounted outside the compressor 10, as described later.

In addition, the upper support plate 62 is provided thereon with a discharge tube 108 for communicating the discharge sound silencer chamber 58 of the upper support member 54 with the inner space of the enclosed container 12. A vapor compression type refrigeration cycle is established in the apparatus as follows. The refrigerant gas of the second stage high-pressure compression element 34 is discharged directly into the enclosed container 12, thereby rendering the container 12 to maintain a high inner pressure. The gas is then lead to an external condenser (not shown) via a connection tube 96 secured to the upper cover 12B and a refrigerant line 104 connected to the connection tube 96. The refrigerant circulates through the refrigerant circuit as described below, and returns to the first stage low-pressure compression element 32 via the refrigerant line 98, connection tube 90 and the upper refrigerant suction passage of the upper cylinder 38.

It is noted that a smaller clearance is provided for the components in the first stage low-pressure compression element 32 than that in the second stage high-pressure compression element 34. For example, the clearance is about 10 micrometers in the first stage lower pressure element 32, while the clearance is about 20 micrometers in the second stage high-pressure compression element 34. Thus, the higher pressure refrigerant gas in the container 12 is prevented from leaking into the first stage compression element 32 containing the refrigerant gas at a much lower pressure, thereby improving volumetric efficiency and compression efficiency of the compressor.

Next, referring to FIG. 1, the operation of the multi-stage compression refrigeration apparatus equipped with a two-stage compression rotary compressor 10 of the invention will be described.

Figure 1:
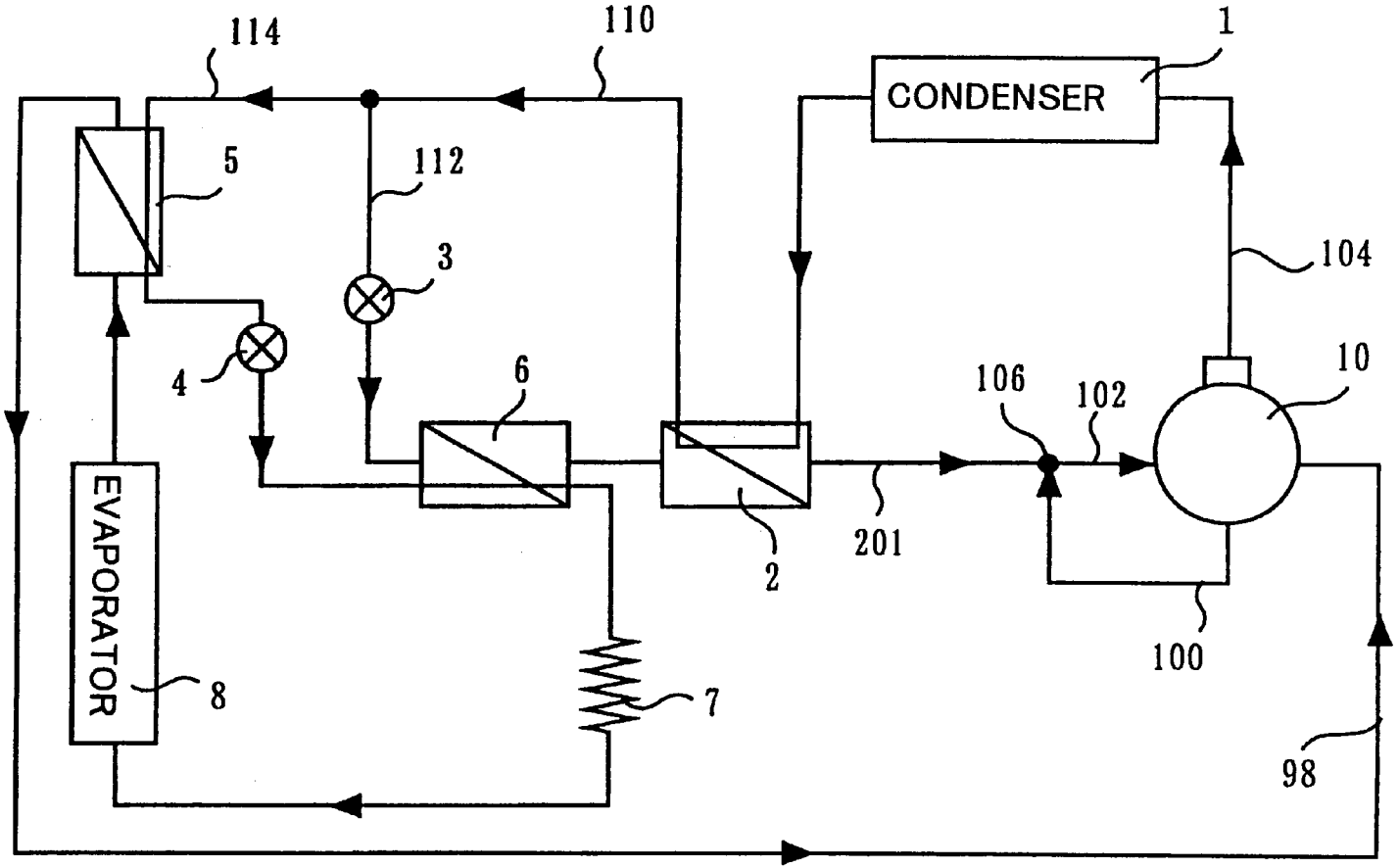
FIG. 1 shows a refrigerant circuit of a multi-stage compression refrigeration apparatus embodying the invention.

As the high-pressure refrigerant is discharged from the two-stage compression rotary compressor 10, it flows into a condenser 1 via a refrigerant line 104, as shown in FIG. 1. The refrigerant is condensed in the condenser 1 and passed through the refrigerant line 110, which refrigerant undergoes heat exchange with a third intercooler 2, as described later. The refrigerant line 110 is bifurcated into two refrigerant lines 112 and 114 to divert the refrigerant into first and second parts, respectively.

A first expansion valve 3 is provided in the bifurcated line 112 to serve as a means for decompressing the first part of the refrigerant passing through the line 112.

A second expansion valve 4 is provided in the other bifurcated line 114 to serve as a third decompressing means for decompressing the second part of the refrigerant passing therethrough. The refrigerant flowing through the line 114 is passed to the second intercooler 5 where it undergoes heat exchange with the refrigerant discharged from the evaporator 8. The refrigerant is then led to the second expansion valve 4.

A first intercooler 6 connected to the discharge ends of the first expansion valve 3 and of the second expansion valve 4 permits heat exchange between the first part of the diverted refrigerant decompressed by the first expansion valve 3 and the second part of the refrigerant decompressed by the second expansion valve 4. The intercooler 6 has a storage container (not shown) which is adapted to temporarily store the refrigerant discharged from the second expansion valve 4 for separation of the refrigerant in the gas phase from the refrigerant in the liquid phase to supply only the liquid refrigerant to a capillary tube 7. The first part of the refrigerant discharged from the first expansion valve 3 and passed through the first intercooler 6 for the heat exchange is further passed to the third intercooler 2 for further heat exchange with the refrigerant discharged from the condenser 1. The second part of the refrigerant cooled by the third intercooler 2, the second intercooler 5, and the second expansion valve 4 is also passed to the first intercooler 6, where the refrigerant is stored temporarily for separation of the two phases, of which only the liquid refrigerant is allowed to flow into the capillary tube 7 serving as a second decompression means. Hence, it is possible to provide the capillary tube 7 with only liquid refrigerant without being affected by external disturbances such as ambient temperature, thereby preventing the refrigerant from being much too decompressed in the capillary tube 7 to obtain anticipated refrigeration temperature.

Both the second intercooler 5 and the third intercooler 2 have a double tube structure having an inner and an outer tubes to perform heat exchange between two portions of the refrigerants passing through the respective tubes in the opposite directions to improve heat exchange efficiency, with a colder refrigerant through the inner tube and a hotter refrigerant through the outer tube.

Although the second intercooler 5 and third intercooler 2 are susceptible to ambient conditions, the double tube structure enables realization of efficient supercooling of the refrigerant in those heat exchanging sections other than the first intercooler 6.

The refrigerant discharged from the third intercooler 2 flows into the suction muffler 106 via the refrigerant line 201, where the refrigerant is mixed with the refrigerant discharged thereinto from the first stage low-pressure compression element 32 via the refrigerant line 100.

The refrigerant gas discharged from the suction muffler 106 is fed to the second stage high-pressure compression element 34 by the refrigeration line 102.

The tube 7 is a capillary tube serving as the second decompression means for decompressing the refrigerant discharged from the second expansion valve 4 to the first intercooler 6 for heat exchange. The refrigerant discharged from the capillary tube 7 is supplied to the evaporator 8, where it is heated by the ambient air to evaporate. Connected to the outlet of the evaporator 8 is the second intercooler 5, where the refrigerant undergoes heat exchange with refrigerant passing through the refrigerant line 114. The refrigerant is then passed, via the refrigerant line 98, to the connection tube 90 of the first stage low-pressure compression element 32 of the two-stage compression rotary compressor 10.

This completes the refrigeration cycle of the multi-stage compression refrigeration apparatus of the invention.

The first intercooler 6, second intercooler 5, and third intercooler 2 absorb heat from their surroundings to perform required refrigeration. The heat exchanger of these intercoolers will be hereinafter referred to as the first, second, and third supercooling sections, respectively.

In the description given above, the refrigerant is supercooled once in the second supercooling section and then passed to the first supercooling section via the second expansion valve 4. This is based on our finding that the heat transfer efficiency is improved by subjecting the refrigerant to supercooling once before expansion and once after expansion by a decompressor.

Figure 3:
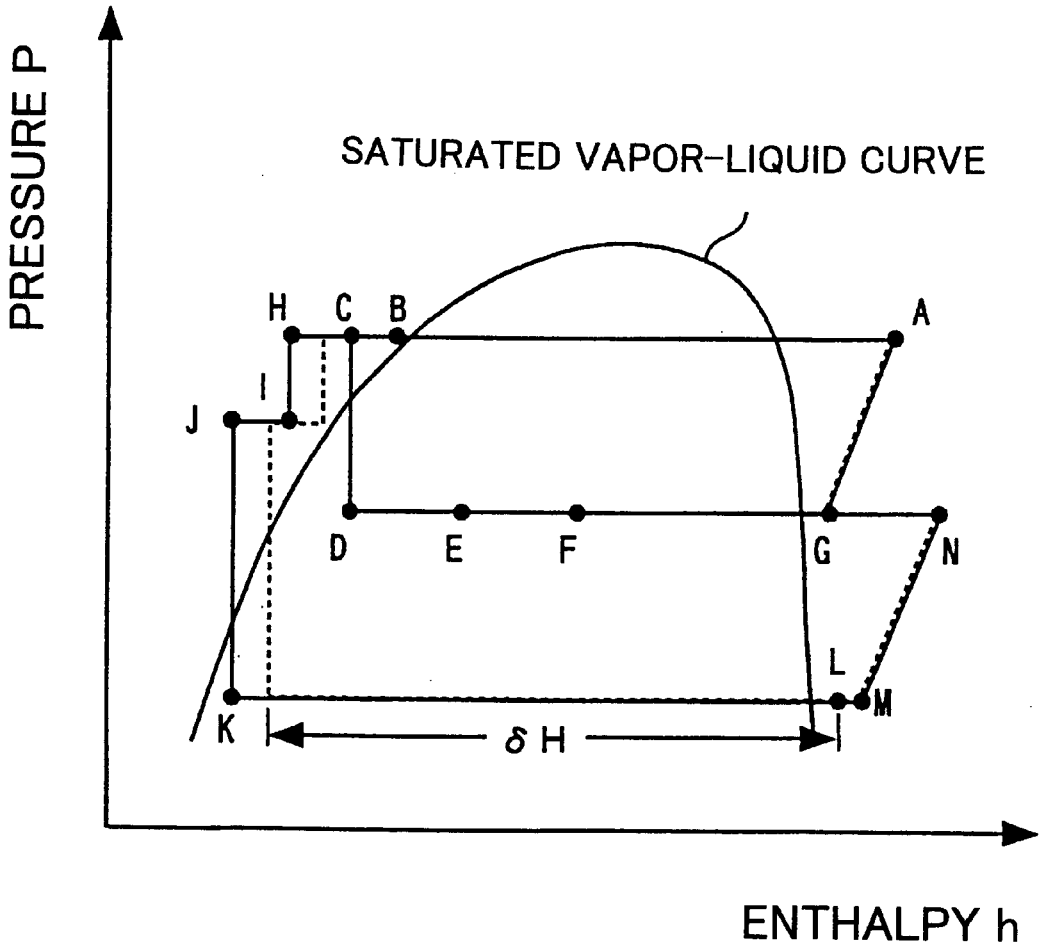
FIG. 3 is a P-h diagram of a multi-stage compression refrigeration apparatus of the invention.

Thermodynamic conditions of the refrigerant during a refrigeration cycle as described above will now be described with reference to FIG. 3 showing the P-h diagram. In this figure, a change in thermodynamic state of the refrigerant during a normal operation of the apparatus is illustrated by a solid line, while the change in state of the refrigerant during an early stage of startup is illustrated by a broken line.

In FIG. 3, point A represents the state of the refrigerant discharged from the second stage high-pressure compression element 34 of the two-stage compression rotary compressor 10. The refrigerant undergoes a change from point A to point B when condensed by the condenser 1. Thereafter, the refrigerant is cooled to point C by the heat exchange with the third supercooling section (i.e. the third intercooler 2). At point C, the refrigerant is diverted, with one part decompressed by the first expansion valve 3, and passed to the first intercooler 6 after the pressure is lowered to point D.

The other part diverted at point C is cooled to point H by the heat exchange with the second intercooler 5 connected with the discharge port of evaporator 8 in the second supercooling section, and further decompressed to point I by the second expansion valve 4. In the first supercooling section, the refrigerant undergoes heat exchange at point I with the first intercooler 6, reaching point J. On the other hand, the refrigerant at point D changes its state to point E at the discharge port of the first intercooler 6.

Point F represents the state of the first part of the refrigerant after it has exited the first intercooler 6 and undergone heat exchange in the third intercooler 2 with the refrigerant which has been condensed to state B by the condenser 1 and passed to the third intercooler 2.

The refrigerant is decompressed at point J down to point K by the capillary tube 7 before the refrigerant flows into the evaporator 8. The refrigerant evaporated (at point L) in the evaporator 8 is supercooled, changing its state to point M at the outlet of the second intercooler 5, and then is allowed to flow into the first stage low-pressure compression element 32 of the compressor 10.

The hot and high-pressure refrigerant, now compressed to point N in the first stage low-pressure compression element 32 is led to the suction muffler 106, where the refrigerant is mixed with the part of the refrigerant discharged from a third intercooler 2 (and having a state represented by point F). The mixed refrigerant is cooled to point G. The refrigerant (cooled to point G) is fed to the second stage high-pressure compression element 34 of the two-stage compression rotary compressor 10 for second stage compression (point A) and discharged to the condenser 1.

It is noted that in this way the refrigerant discharged from the condenser 1 can be supercooled in the third supercooling section, and that the second part of the refrigerant passing through the capillary tube 7 and evaporator 8 can be supercooled in the first- and the second-supercooling sections.

It is also noted that sensible heat of supercooling sections can be minimized by providing distributed supercooling sections each having a limited heat capacity. Thus, unlike conventional apparatuses, it is possible to allow supercooling even during an early stage of startup of the apparatus (FIG. 3, broken line) to increase enthalpy difference $\delta H$ in the evaporator 8.

In particular, it would be appreciated that provision of the second supercooling section 5, in addition to the first supercooling section 6, ensures sufficient supercooling of the second part of the refrigerant passing through the capillary tube 7 in a short time subsequent to a startup through heat exchange with the cold refrigerant discharged from the evaporator 8.

Figure 4:
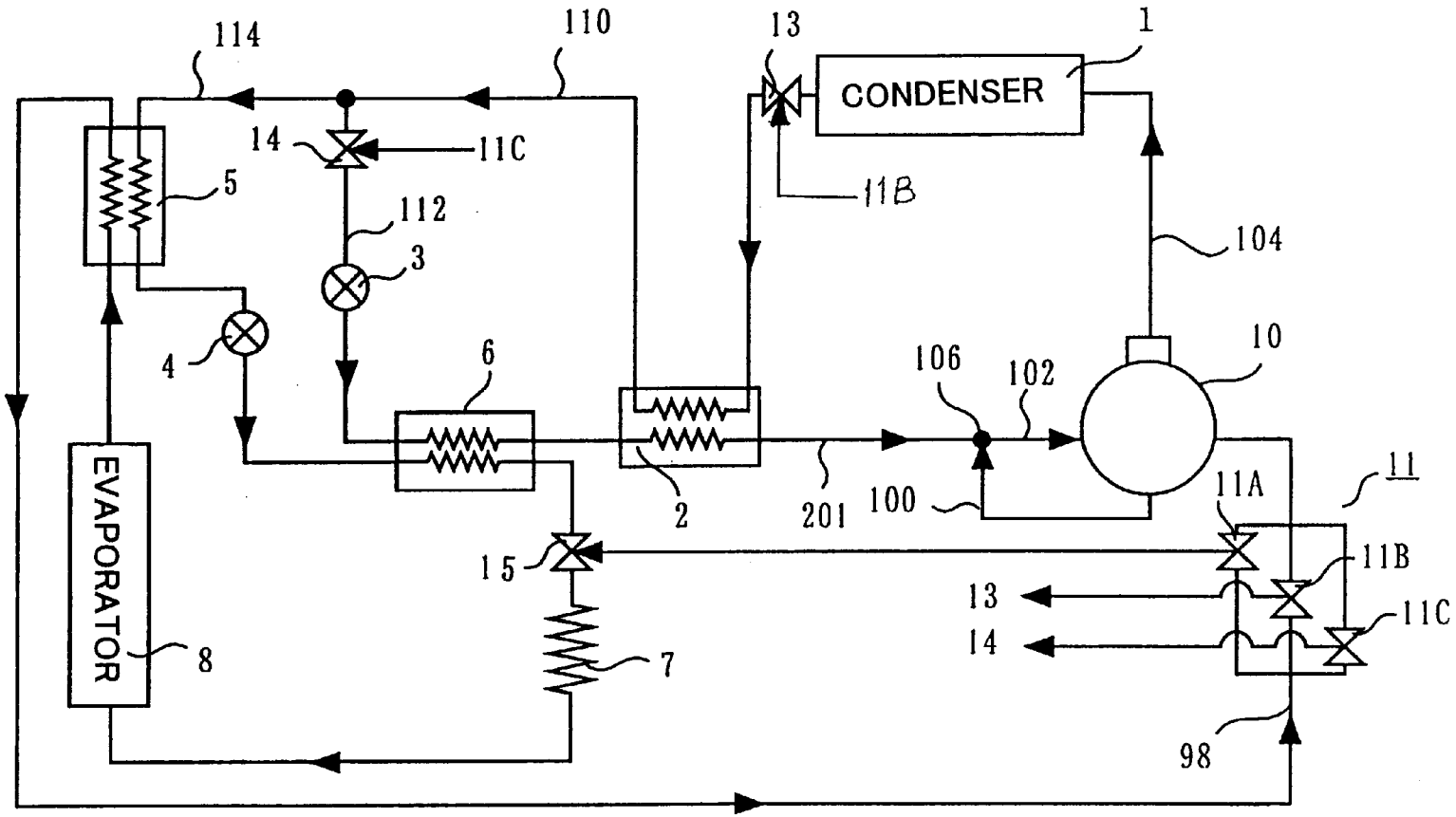
FIG. 4 shows another refrigerant circuit of a multi-stage compression refrigeration apparatus embodying the invention.

FIG. 4 illustrates another embodiment of a refrigerant circuit for use in a multi-stage compression refrigeration apparatus according to the invention, in which like reference numerals refer to like components as in FIG. 1. The embodiment is essentially the same as the one shown in FIG. 1, except that the refrigerant line 98 is now provided inside thereof with first valve mechanisms 11A, 11B, and 11C which are fully closed when a predetermined amount of the refrigerant is directed backward from the two-stage compression rotary compressor 10 to the evaporator 8. The apparatus is further provided with a second valve mechanism 15 mounted in a line upstream of the capillary tube 7, a third valve mechanism 13 mounted in a line downstream of the outlet of the condenser 1, and a fourth valve mechanism 14 mounted in the bifurcated refrigerant line 112 upstream of the first expansion valve 3. These valve mechanisms 15, 13, and 14 are adapted to be opened/closed in response to the respective valve mechanisms 11A, 11B, 11C. The first valve mechanism 11A and the second valve mechanism 15 are integrally fabricated, and so are the first valve mechanism 11B and the third valve mechanism 13, and the first valve mechanism 11C and the fourth valve mechanism 14.

In this arrangement, the pressure in the compressor 10 becomes lower than that in the evaporator 8 as the compressor 10 is started, so that the refrigerant begins to flow from the evaporator 8 to the compressor 10, causing all of the closed valve mechanisms 11A, 11B, 11C and 15, 13, and 14 to be opened.

On the other hand, the compressor 10 is controlled to rotate in the reverse direction for a predetermined period before it is completely stopped. In this way, although the first valve mechanisms 11A, 11B, and 11C and the second, third, fourth valve mechanisms 15, 13 and 14, respectively, are fully opened during normal refrigeration operation, they will be fully closed when a predetermined amount of refrigerant flows backward from the compressor 10 towards the evaporator 8 due to the reverse rotation of the compressor 10.

As a result, the hot liquid refrigerant staying in the condenser 1 is prevented from flowing into the evaporator 8 and the first intercooler 6 following stopping of the compressor 10.

The invention has been described in conjunction with preferred embodiments, which are intended to be illustrative of the invention defined in the claims rather than limiting the invention defined by the appended claims. Variations and modifications of the present invention can be effected within the scope of the invention.

For example, instead of a high-pressure type container 12 for maintaining highly pressurized refrigerant, a low-pressure type container for maintaining refrigerant at a low pressure in substantial equilibrium with the refrigerant in the inlet port of the first stage low-pressure compression element 32, and an intermediate pressure type container for maintaining the refrigerant at an intermediate pressure in substantial equilibrium with the refrigerant in the outlet port of the first stage low-pressure compression element 32 can be utilized.

Figure 5:
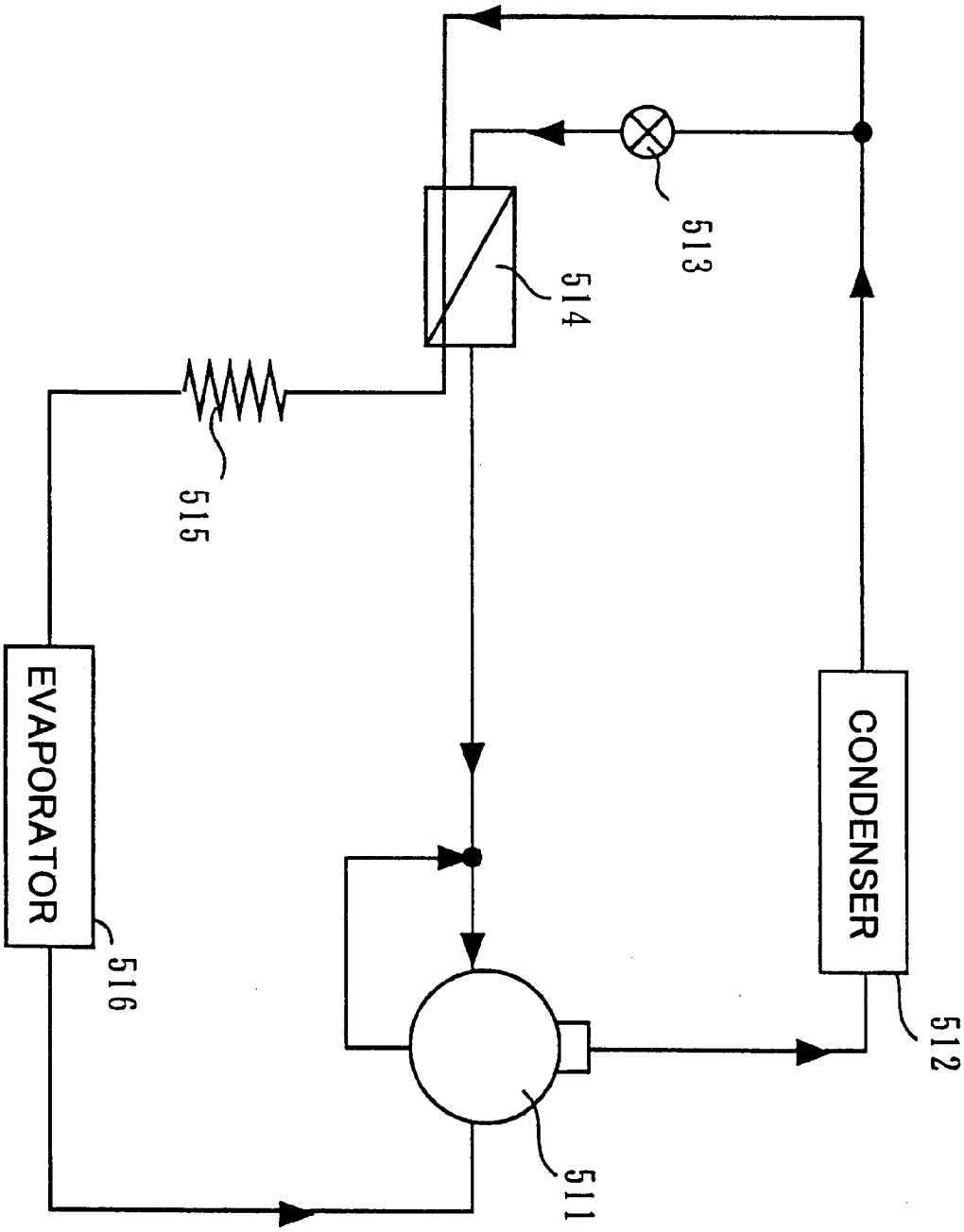
FIG. 5 shows a refrigerant circuit of a conventional multi-stage compression refrigeration apparatus.
Figure 6:
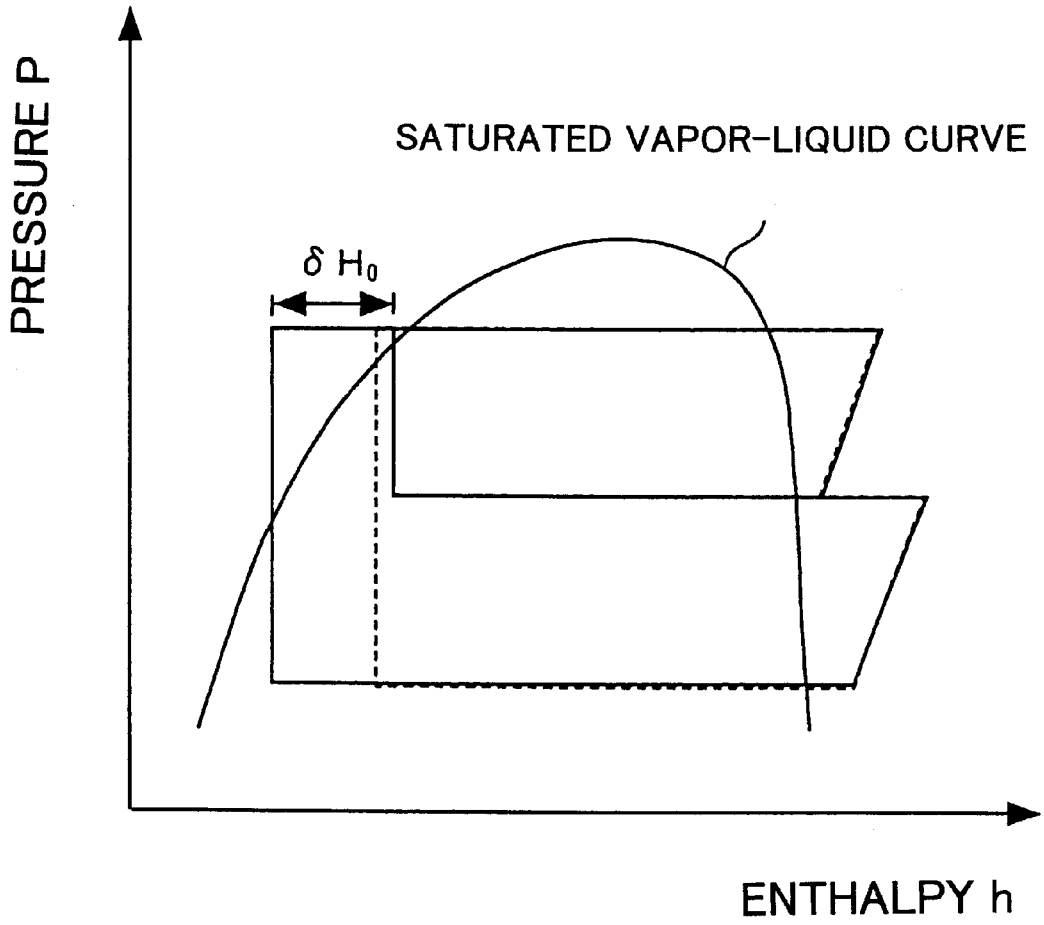
FIG. 6 shows a P-h diagram of a conventional multi-stage compression refrigeration apparatus.

In the example shown herein, an embodiment is shown to have first, second, and third supercooling sections. However, the inventive compressor is not limited to this type. For example, the invention may be applied toga conventional compression apparatus (FIG. 5) having a single intercooler for supercooling, as defined in claim 4.

Different refrigerants can be used equally well in place of R134*a* used in the above example.

INDUSTRIAL UTILITY

In accordance with the invention, refrigerant compressed in and discharged from a first stage low-pressure compressor is further cooled to suppress the temperature of the refrigerant discharged from the high-pressure compressor, thereby creating a large enthalpy difference in the evaporator to improve the refrigeration efficiency of the apparatus during an early stage of its startup.

In addition, when the compressor is stopped, the second and the third valve mechanisms are fully closed in cooperation with the first valve mechanism which is closed in response to the backflow of refrigerant though the first valve mechanism, safely preventing backflow of refrigerant to the evaporator and the intercoolers. Thus, the invention may increase the enthalpy difference in the evaporator during an early stage of startup of the apparatus, thereby improving the refrigeration performance thereof.

What is claimed is:

1. A multi-stage compression refrigeration apparatus including a compressor having a first stage low-pressure compression means and a second stage high-pressure compression means, a condenser, a first decompression means, a first intercooler, a second decompression means, and an evaporator, wherein the refrigerant discharged from the second stage compression means is passed through the condenser, and is diverted into first and second parts, with the first part passed to the first intercooler via the first decompression means while the second part is passed to the first intercooler to undergo heat exchange therein with the first part, and then passed to the second decompression means, the evaporator, and then to the first stage low-pressure compression means; and wherein the first part of the refrigerant exiting the first intercooler is mixed with the second part of the refrigerant discharged from the first stage low-pressure compression means before they are fed to the second stage high-pressure compression means of the multi-stage compression refrigeration apparatus, the apparatus comprising a second intercooler mounted downstream of said evaporator and adapted to perform heat exchange between the refrigerant that has passed said evaporator and said second part of the refrigerant before entering said evaporator, and a third intercooler provided downstream of the condenser for performing heat exchange between the refrigerant discharged from the condenser and the refrigerant discharged from the first intercooler before the latter refrigerant is mixed with the refrigerant exiting the first stage compression means, thereby feeding the mixed refrigerant to the second stage compression means.

2. The refrigeration apparatus according to claim 1, further comprising a third decompression means for decompressing the second part of said diverted refrigerant exiting said second intercooler before entering said evaporator.

3. A multi-stage compression refrigeration apparatus including a compressor having a first stage low-pressure compression means and a second stage high-pressure compression means, a condenser, a first decompression means, a first intercooler, a second decompression means, and an evaporator, wherein the refrigerant discharged from the second stage compression means is passed through the condenser, and is diverted into a first and a second parts, with the first part passed to the first intercooler via the first decompression means while the second part is passed to the first intercooler to undergo heat exchange therein with the first part, and then passed to the second decompression means, the evaporator, and then to the first stage low-pressure compression means; and wherein the first part of the refrigerant exiting the first intercooler is mixed with the second part of the refrigerant discharged from the first stage low-pressure compression means before they are fed to the second stage high-pressure compression means of the multi-stage compression refrigeration apparatus, the apparatus further comprising:

a first valve mechanism which is mounted upstream of the first stage compression means and adapted to be fully closed in response to a predetermined amount of backflow of refrigerant from the first stage compression means towards the evaporator;

a second valve mechanism which is mounted upstream of the evaporator and adapted to be opened/closed in cooperation with the first valve mechanism; and a third valve mechanism mounted downstream of the condenser, adapted to be opened/closed in cooperation with the first valve mechanism.

4. The refrigeration apparatus according to claim 3, further comprising a fourth valve mechanism which is mounted upstream of the first decompression means and adapted to be opened/closed in cooperation with the first valve mechanism.

5. The refrigeration apparatus according to claim 3 or 4, wherein the compressor is a multi-stage compression rotary compressor having a multi-stage compression mechanism which includes:

an electric motor contained in an enclosed container;

a rotary compression element having a first stage low-pressure compression element and a second stage high-pressure compression element, both elements operatively coupled to the drive shaft of the electric motor element; and a communicating tube for connecting the discharge port of the first stage low-pressure compression element with the inlet port of the second stage high-pressure compression element.

6. The refrigeration apparatus according to claim 3 or 4, wherein the compressor is adapted to run in a reverse direction for a predetermined period of time before the compressor is stopped.

7. The refrigeration apparatus according to claim 3 or 4, wherein each of the second, third, and fourth valve mechanisms are constructed integral with an associated first valve mechanism.

8. The refrigeration apparatus according to claim 3 or 4, wherein the second decompression means is a capillary tube, and the second valve mechanism is connected to the inlet of the capillary tube.

9. The refrigeration apparatus according to claim 3 or 4, further comprising:

a third decompression means adapted to decompress the second part of the refrigerant prior to flowing in the first intercooler; and a second intercooler adapted to perform heat exchange between the second part of the refrigerant prior to flowing into the third decompression means and the refrigerant discharged from the evaporator.

10. The refrigeration apparatus according to claim 9, further comprising a third intercooler adapted to perform heat exchange between the first part of the refrigerator passed through the first intercooler, and the second part of the refrigerant discharged from the condenser.

* * * * *